United States Patent [19]

Zinke

[11] 4,181,492

[45] Jan. 1, 1980

[54] TORCH IGNITER

[75] Inventor: Andrew E. Zinke, Houston, Tex.

[73] Assignee: Striker, Inc., Houston, Tex.

[21] Appl. No.: 841,016

[22] Filed: Oct. 11, 1977

[51] Int. Cl.[2] ..... F23Q 3/00

[52] U.S. Cl. ..... 431/264; 310/339

[58] Field of Search ..... 431/255, 264, 266, 273, 431/276; 310/339

[56] References Cited

U.S. PATENT DOCUMENTS

| | | | |
|---|---|---|---|
| 1,407,306 | 2/1922 | Turpin et al. | 431/264 |
| 3,052,112 | 9/1962 | Wheeler | 431/276 |
| 3,947,731 | 3/1976 | Vainer | 431/255 |

FOREIGN PATENT DOCUMENTS

| | | | |
|---|---|---|---|
| 948655 | 2/1964 | United Kingdom | 431/255 |

*Primary Examiner*—Carroll B. Dority, Jr.

[57] ABSTRACT

Apparatus is disclosed for igniting gas emitted through a tip of gas a burning torch. The apparatus includes means having an electrode which discharges a spark for igniting the gas emitted through the tip. A frame is used to support the gas igniting means on the torch and permits movement of the electrode from a stored position to an igniting position, so that upon discharge of the spark, the gas emitted from the tip is ignited. A hanger is adapted to fit a portion of the torch to attach the frame to the torch so that the frame is usable with different torches by using a different hanger.

8 Claims, 8 Drawing Figures

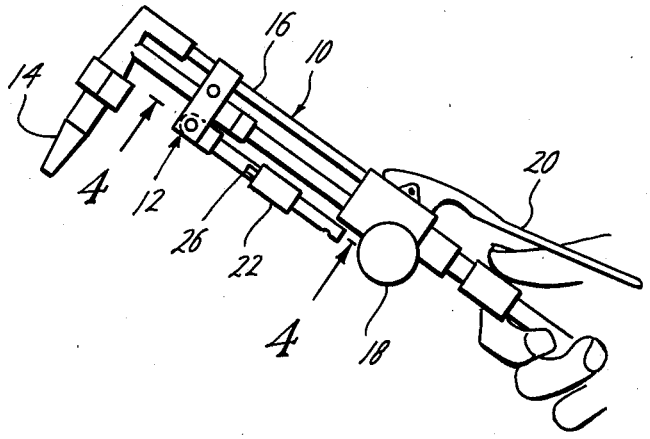
Fig. 1
Fig. 2
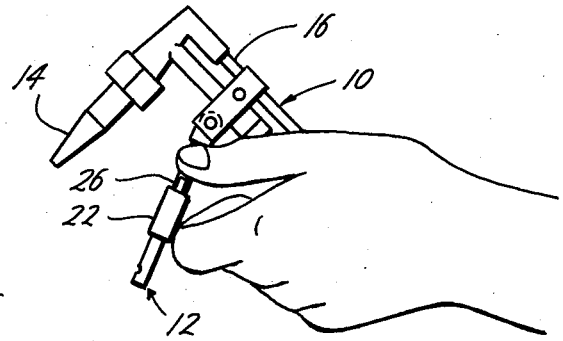
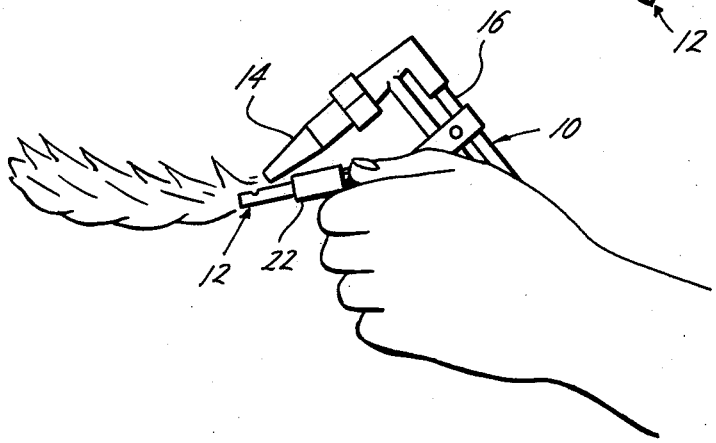
Fig. 3

TORCH IGNITER

Gas burning torches used in cutting, welding, soldering and brazing metals are well known in the art. The torches generally have the same structure which includes a tip connected to tubing for placing the tip in gas communication with a gas source, such as a gas tank. The main difference between the torches is in the selection of the tip for the particular use.

When using these torches, the user frequently stops and lays the torch down, which means the torches are turned off to prevent possible fires or burns to fellow workers and to save on the use of gas. It is therefore necessary for the user to re-ignite the torch for resumption of his task. Because of this frequent use of igniters, it is important to have them handy to insure that users are kept busy at their task.

The most common igniter is a device separate from the torch called a "cup-type striker". This striker has a cup with a rough surface provided therein disposed on one end of a spring and a flint disposed on the other end of the spring. To ignite the emitted gas, the cup is positioned in the gas stream and the flint swiftly moved over the rough surface to strike a spark in the gas. A problem is involved with separate igniters because they are separate from the torch. To understand the problem, it must be remembered that the user ignites the torch, lays down the igniter and commences the assigned task. After a period of use, the torch is turned off and the user then begins looking for the igniter to re-ignite the torch. The user either goes back to where the igniter was laid down to get the igniter or in the event he forgot where the igniter was left, must search for another igniter. Thus, the problem is the substantial waste of time caused by this search for igniters. A problem with the specific "cup-type striker" is that water, such as rain water, will prevent sparking. Thus, special handling is required to keep the striker dry.

A suggested solution to the former problem is to provide a striker for every torch user. However, this solution does not account for the forgetfulness on the torch users. The strikers are, thus misplaced by the user while on the job or the users forget to bring them to the job each day.

Another suggested solution to the former problem is to provide an igniter for use at the gas regulator on the gas tanks. The user then goes to the regulator each time the torch is to be ignited. Users, however, generally do not believe they will loose the igniter so they take the igniter off the regulator and carry it with them with the above results.

A suggested solution to both problems is a torch which is ignited by an electrode constructed integrally within the torch. Some examples of this type of torch are provided in U.S. Pat. Nos. 2,383,046; 3,220,459; 3,255,803; 3,280,881; 3,431,058; 3,436,164; 3,667,895 and 3,694,134. In some of these torches the electrode remains in the burning gas so that the electrode material must be selected to be heat resistant or the electrode will disentegrate. In other of these torches, a quantity of the gas is ignited in a combustion chamber and carried to the tip to ignite the emitted gas. Thus, a potential hazard exists if the gas builds up in the combustion chamber to cause the torch to explode. In both types of these torches, the high temperatures of the burning gas is transferred to the electrode which changes its electrical resistance and prevents the discharge of a spark therefrom. Also, in both types of these torches, the time waste problems are not solved for torches without the integral electrode already in use.

Accordingly, it is a primary object of the present invention to provide apparatus for igniting gas emitted through the tip of a gas burning torch which is movable from a stored position, where the electrode is positioned away from the tip, to an igniting position.

Another object of the present invention is to provide apparatus for igniting gas emitted through the tip of a gas burning torch which is attachable to a conventional torch without modifying the torch.

Another object of the present invention is to provide apparatus for igniting gas emitted through the tip of a gas burning torch for eliminating the misplacing of the igniter to save the time lost in searching for a misplaced igniter.

Another object of the present invention is to provide apparatus for igniting gas emitted through the tip of a gas burning torch which will eliminate the potential hazard of the torch exploding when the gas is ignited in a combustion chamber provided in the torch.

Another object of the present invention is to provide apparatus for igniting gas emitted through the tip of a gas burning torch which will eliminate the disintegration of an electrode used to ignite the gas without requiring the special selection of materials for making the electrode.

Another object of the present invention is to provide apparatus for igniting gas emitted through the tip of a gas burning torch which may be used on torches of different configuration by slight modification in the apparatus design.

In accordance with the invention, apparatus is provided which ignites gas emitted through a tip of a gas burning torch. This apparatus includes a means having an electrode to discharge a spark for igniting the gas emitted through the tip. A frame supports the gas igniting means on the torch and permits movement of the electrode from a storing position, where the electrode is positioned away from the tip, to an igniting position, where the electrode is positioned sufficiently near the tip so that a spark discharged by activation of the gas igniting means will ignite the emitted gas. A hanger may be used which has an attaching configuration adapted to fit a portion of the torch for attaching the frame mechanism to the torch so that a frame of a single design can be attached to different torches simply by changing the attaching configuration of the hangers.

Other objects and advantages of the invention will become apparent upon reading the following detailed description and upon reference to the drawings, in which like reference numerals are used throughout the drawings to designate like parts:

FIG. 1 is a side view of apparatus constructed according to the present invention attached to a conventional gas burning torch with the electrode shown in the storing position.

FIG. 2 is a side view of the embodiment of the invention shown in FIG. 1 with the electrode shown being swung toward the igniting position.

FIG. 3 is a side view of the invention shown in FIG. 1 with the electrode shown in the igniting position and with the gas emitted through the tip being shown ignited.

Figure 4:
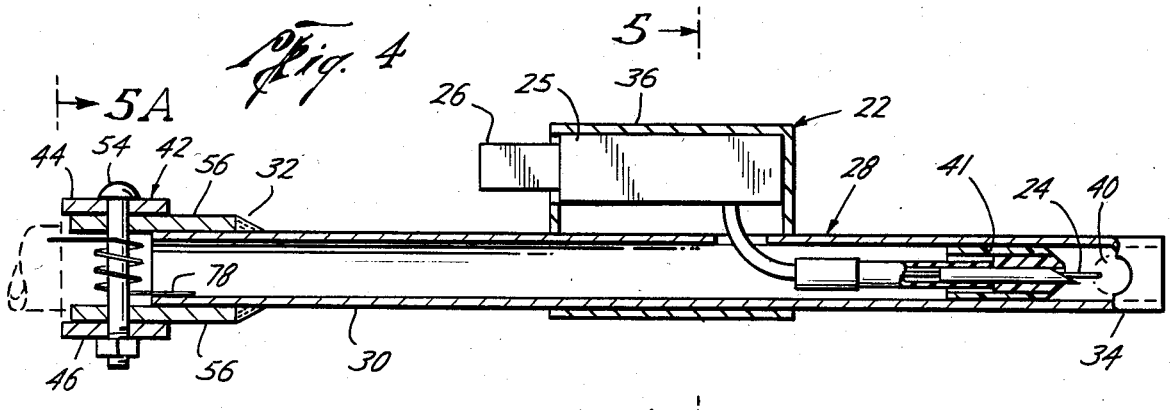
FIG. 4 is an enlarged front view, partly in section, taken in the direction of arrows 4—4 of the apparatus shown in FIG. 1.

While the invention will be described in connection with two embodiments, it will be understood that it is not intended to limit the invention to these embodiments. On the contrary, it is intended to cover all alternatives, modifications and equivalents as may be included within the spirit and scope of the invention as defined by the appended claims.

Turning now to FIGS. 1-3 and 6, a conventional gas burning torch 10 is shown having apparatus 12 attached thereto. Gas burning torch 10 is of conventional structure and includes a tip 14 connected to tubing 16, which places the tip in gas communication with a gas source (not shown). A valve 18 and lever 20 are operably connected within torch 10 to tubing 16 to control the flow of gas out tip 14. Torch 10 is shown having a typical construction with tip 14 lying in a plane with tubing 16.

Figure 7:
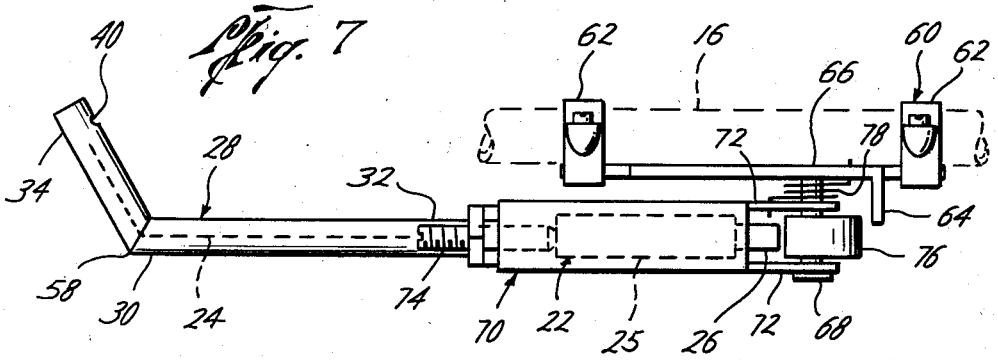
FIG. 7 is an enlarged rear view taken in the direction of arrows 7—7 of the apparatus shown in FIG. 6.

A means 22 is provided for igniting the gas emitted through tip 14. As shown in FIGS. 4 and 7, igniting means 22 has an electrode 24 which discharges a spark to ignite the gas being emitted through tip 14. Preferably, gas igniting means 22 is a piezoelectric generator having a piezoelectric crystal disposed within housing 24 which causes a spark to discharge from electrode 24 when struck, a hammer for striking the crystal and a plunger 26 for activating the hammer disposed within plunger 26 to strike the crystal. An example of such a generator is that sold by Rion Co., Ltd. under the trade name PR-24.

Figure 5:
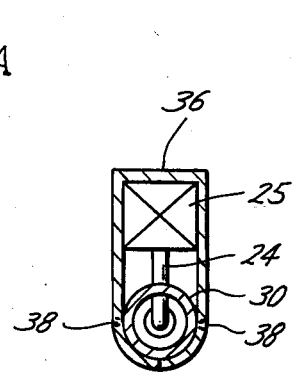
FIG. 5 is a view of the apparatus shown in FIG. 4 taken in the direction of arrows 5—5.
Figure 6:
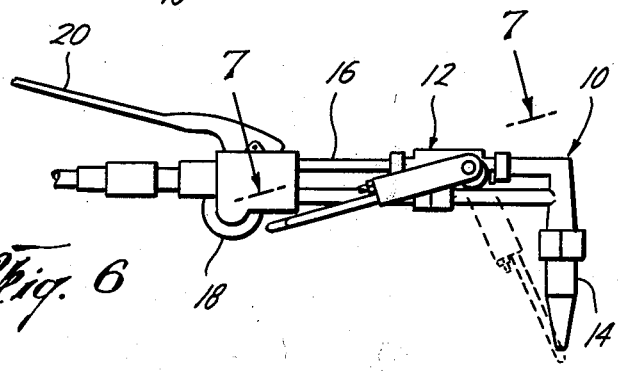
FIG. 6 is a side view of a second apparatus, constructed according to the present invention, attached to a conventional gas burning torch with the electrode in the igniting position shown in dotted outline.

A frame 28 is provided to support gas igniting means 22 on torch 10 while permitting movement of electrode 24 away from a storing position, where the electrode is positioned away from tip 14 (FIGS. 1 and 6) to an igniting position, where electrode 24 is positioned sufficiently near tip 14 so that a spark discharged therefrom will ignite the gas emitted from tip 14 (FIGS. 3 and 6). Preferably, frame 28 includes a tubular lever arm 30 pivotally connected to torch 10 at a first end 32 and supporting the electrode 24 on a second end 34. As shown in FIGS. 4 and 5, gas igniting means 22 is supported within an enclosure 36 fixed to lever arm 30. Enclosure 36 is fixed to arm 30 by any conventional means, such as by spot welds 38. Electrode 24 is then run from gas igniting means 24 down through tubular arm 30 to second end 34. A hole 40 may be located in the second end 34 (shown in FIGS. 1-4 and 6-7) for positioning within the emitted gas with the spark being discharged across the hole or electrode 24 may extend to the end of second end 34 (not shown) for positioning within the emitted gas with the spark being discharged across the end. To prevent shorting of electrode 24 along arm 30, an insulator 41 is provided within tubular arm 30 around electrode 24. This insulator may be made from a plastic material as shown or from a ceramic material, depending on the amount of abuse the igniter receives from the user. Thus, in the embodiments shown, opening 40 is positioned within the gas emitted through tip 14 by swinging arm 30 from the storing position to the igniting position and the emitted gas is ignited by depressing plunger 26.

A hanger 42 is used for attaching frame 28 to torch 10 and has an attaching configuration adapted to fit a portion of the torch. This attaching configuration is designed for different torch configurations to permit frame 28 and igniting means 22 to be used on different torch configurations by using different hangers. Thus, the only required change in the embodiment of the invention shown in FIGS. 1-5A for a welding torch and a cutting torch is hanger 42.

Figure 5A:
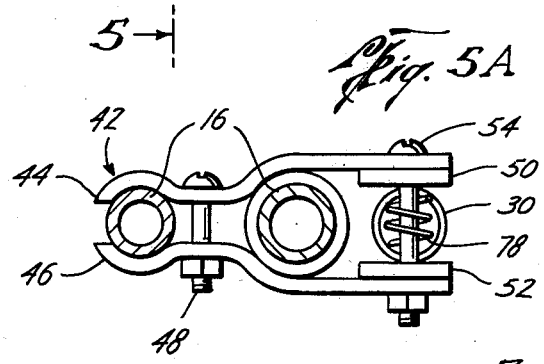
FIG. 5A is a view of the apparatus shown in FIG. 4 in the direction of arrows 5A—5A.

As best shown in FIGS. 4 and 5A for the embodiment of the invention shown in FIGS. 1-5A, hanger 42 is split into facing halves 44 and 46. For the torch configuration shown, halves 44 and 46 clamp on each side of tubing 16 and are held in place by conventional fastening devices, such as nut and bolt 48. Halves 44 and 46 have tabs 50 and 52 extending in a parallel direction from tubing 16. A rod 54, such as provided by the shown bolt, runs between the tabs for pivotally supporting parallel plates 56 welded to first end 32 of arm 30. Thus, lever arm 30 swings from the stored position, which nests against tubing 16 to protect the apparatus against possible damage.

In operation, a hanger 42 is selected to fit the configuration of torch 10 and attached thereto by bolt and nut 48. Frame 28 with igniting means 22 fixed thereto is pivotally connected to hanger 42 by positioning parallel plates 56 between tabs 50 and 52 and held there by bolt 54. Hanger 42 is then adjusted to insure that a spark discharged from electrode 24 will be in the gas emitted from tip 14. After the adjustment is made, apparatus 12 is attached to torch 10 for igniting the gas emitted from tip 14 by moving swing arm 30 from the stored position to the igniting position and pressing plunger 26 to discharge a spark from electrode 24. Thus apparatus 12 cannot be misplaced or lost by the user.

The embodiment of the invention shown in FIGS. 6 and 7 may be attached to the same torches as the embodiment shown in FIGS. 1-5A. The gas igniting means 22 are the same as described above. The frame 28 uses a similar tubular lever arm 30 with electrode 24 provided therein as described above, except that arm 30 has an elbow 58 bent sidewardly because apparatus 12 is offset from torch 10.

A hanger 60 is used for attaching frame 28 to torch 10 as above, but uses two conventional universal hose clamps 62 to secure a support plate 64 to the torch. As shown in FIGS. 6-7, plate 64 is held against tubing 16 to form a relatively flat surface. A bolt 66 inset into the tubing side of plate 64 extends perpendicular to the flat surface and has a nut 68 attached thereto. An intermediate support 70 has tabs 72 pivotally attached to bolt 66 and supports ingiting means 22 on arm 30. An adjusting bolt 74 is provided in intermediate support 70 for moving plunger 26 relative to an eccentric cam 76 fixed to bolt 66. In this embodiment bolt 74 is moved to adjust the position of the piezoelectric generator 22 relative to cam 76. This adjustment is made to cause the hammer to strike the crystal when second end 34 is in the igniting position, the hammer being activated by plunger 26 following the surface of cam 76. Thus, after the adjustment is made, torch 10 is ignited in this embodiment simply by swinging arm 30 from the stored position to the igniting position.

A means 78 may be used for retaining electrode 24 in the stored position when the electrode is not being used to ignite the emitted gas. Means 78 is, preferably, a coil spring wrapped around rod 54 in the embodiment shown in FIGS. 4 and 5A, and around bolt 66 in the embodiment shown in FIGS. 6 and 7. Thus, after the emitted gas is burning, means 78 urges frame 28 to return to the storing position for retaining thereat.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made within the invention without departing from the scope thereof, it is to be understood that all matter herein set forth or shown in the accompanying drawings is to be interpreted as illustrious and not in a limiting sense.

What is claimed is:

1. Apparatus used to ignite gas emitted through a tip of a portable hand held gas burning torch used for cutting, welding soldering or brazing of metals, comprising a piezoelectric generator having an electrode which discharges a spark for igniting the gas being emitted through the tip, said generator having a manually operable plunger for causing said generator to apply an electrical potential to said electrode upon manual operation of said plunger, a single arm supporting said generator, said electrode terminating adjacent one extremity of said arm, pivotal support means for supporting said gas igniting means on said torch and for permitting swinging movement of the electrode from a stored position, where the electrode is positioned away from the tip and the arm lies substantially parallel to the torch and the electrode is protected by the structure of the torch, to an igniting position, where the electrode is positioned immediately adjacent the tip in the path of gas emerging from said tip so that a spark discharged by activation of said gas igniting means will ignite the gas being emitted from the tip and whereby ignition of said gas is initiated immediately adjacent said tip.

2. The apparatus of claim 1, including means for retaining the arm and electrode in the stored position until said gas igniting means is manually swung to the igniting position and used to ignite the emitted gas.

3. Apparatus used to ignite gas emitted through a tip of a portable, hand held gas burning torch used for cutting, welding, soldering or brazing metals, comprising a piezoelectric generator having an electrode which discharges a spark for igniting the gas being emitted through the tip, said generator having a manually operable plunger for causing said generator to apply an electrical potential to said electrode, a frame including a single arm supporting said gas igniting generator on said torch means pivotally mounting said arm relative to said torch and permitting swinging movement of the electrode from a stored position where said arm is disposed in substantially parallel relation with said torch and said electrode is protected by the structure of said torch to an igniting position where the extremity of said electrode is positioned in the path of gas flowing from said tip so that upon discharge of a spark from the electrode the gas emitted from the tip is ignited, and a hanger for attaching said frame to the torch and having an attaching configuration adapted to fit a portion of the torch, said frame is thereby attachable to different torches by changing the attaching configuration of said hanger.

4. The apparatus of claim 3, wherein said arm is of at least partially tubular configuration defining a protective enclosure for said electrode, said arm being pivotally connected to said hanger at a first end and supporting the electrode on a second end within said tubular portion of said arm, the electrode being swung with the arm from the stored position to the igniting position.

5. The apparatus of claim 4, wherein said torch includes tubing placing the tip in gas communication with a gas source and the hanger having an attaching configuration for the tubing so that the lever arm rests against the tubing in the stored position to aid in protecting the apparatus against damage.

6. The apparatus of claim 4, including means for retaining the second end of said lever arm in the storing position until said gas igniting means is used to ignite the emitted gas.

7. The apparatus of claim 6, wherein said retaining means is a spring interconnecting said lever arm to said hanger means to urge the second end of said lever arm into the storing position.

8. Apparatus used to ignite gas emitted through a tip of a gas burning torch, comprising means having an electrode which discharges a spark for igniting the gas being emitted through the tip, a frame for supporting said gas igniting means on said torch and for permitting movement of the electrode from a stored position to an igniting position so that upon discharge of a spark from the electrode the gas emitted from the tip is ignited, and a hanger for attaching said frame to the torch and having an attaching configuration adapted to fit a portion of the torch, said frame is thereby attachable to different torches by changing the attaching configuration of said hanger, said frame includes a lever arm pivotally connected to said hanger at a first end and supporting the electrode on a second end, the electrode being swung with the arm from the stored position to the igniting position, said gas igniting means includes a piezoelectric generator supported by said lever arm having a piezoelectric crystal which causes a spark to discharge from the electrode when struck, a hammer for striking the piezoelectric crystal and a plunger for activating the hammer to strike the crystal, and including an eccentric cam secured by said hanger to the torch, the plunger being located on the lever arm and following the cam surface as the lever arm is swung from the stored position for activating the hammer to strike the crystal which causes a spark discharge upon arrival of the electrode at the igniting position.

* * * * *